United States Patent [19]

Tsubakihara et al.

[11] Patent Number: 4,460,033

[45] Date of Patent: Jul. 17, 1984

[54] METHOD FOR CONTINUOUS CASTING OF STEEL

[75] Inventors: Osamu Tsubakihara; Koji Kagaya; Hiroo Okada, all of Sakaishi; Katsuhiro Kawashima, Fukuokaken, all of Japan

[73] Assignee: Nippon Steel Corporation, Tokyo, Japan

[21] Appl. No.: 280,550

[22] Filed: Jul. 2, 1981

[30] Foreign Application Priority Data

Jul. 3, 1980 [JP] Japan ..... 55-91043

[51] Int. Cl.[3] ..... B22D 11/16

[52] U.S. Cl. ..... 164/454; 164/455

[58] Field of Search ..... 164/414, 454, 455, 413, 164/453

[56] References Cited

U.S. PATENT DOCUMENTS 4,134,440 1/1979 Kawawa ..... 164/414 X

FOREIGN PATENT DOCUMENTS 57-17359 1/1982 Japan ..... 164/455

*Primary Examiner*—Nicholas P. Godici
*Assistant Examiner*—Jerold L. Johnson
*Attorney, Agent, or Firm*—Wenderoth, Lind & Ponack

[57] ABSTRACT

In a method for continuous casting of steel, a slab having good quality is obtained by inspecting the profile of the unsolidified region of the slab in the transverse direction thereof during casting and controlling the cooling pattern so that the profile matches a pre-determined standard profile.

4 Claims, 13 Drawing Figures

METHOD FOR CONTINUOUS CASTING OF STEEL

BACKGROUND OF THE INVENTION

1. Field of the Invention

This invention relates to a method for continuous casting of steel and more particularly to a method for continuous casting of steel by which it is possible to obtain high-temperature slabs having fewer inside defects and which is suitable for direct rolling.

2. Description of the Prior Art

Recently, in the steel industry, in order to increase production efficiency and save energy, the so-called continuous casting-direct rolling method (hereinafter referred to simply as the CC-DR method) has been employed. In this method a continuous cast slab in a high-temperature state—that is, without being cooled—is sent directly to the rolling step for rolling.

However, in rolling a continuous cast slab by the CC-DR method, both edge portions of the slab cool to a temperature unsuitable for rolling and hence it is necessary to employ so-called edge heating, a troublesome step in which the edge portions of the slab are heated before it is supplied to the rolling step.

To eliminate such edge heating, various ways of controlling the continuous casting condition, particularly the cooling, so as to obtain a continuous cast slab having a higher temperature have been considered. However, up to now a satisfactory continuous casting method for obtaining a slab having no inside defects such as segregation has not been found.

SUMMARY OF THE INVENTION

The inventors have investigated rolling methods for obtaining high-temperature slabs having fewer inside defects and using less energy suitable for practical use in the CC-DR method wherein a continuous cast slab is immediately rolled in the high-temperature state or is rolled after performing slight edge heating of the slab. As a result, the inventors have discovered that it is very important to control the casting in such a manner that the sectional profile in the width direction—that is, the peripheral shape—of the unsolidified portion in the inside of the slab during the continuous casting step is kept optimum, and based on the discovery, the method of this invention has been attained.

An object of this invention is, therefore, to provide a method for continuous casting of steel which produces slabs suitable for the CC-DR method and having a high temperature and fewer inside defects.

Other objects of this invention will be made clear by the following description.

According to this invention, there is provided a method for continuous casting of steel which comprises inspecting the profile of the unsolidified region inside of the shell in the cross section of a slab transverse to the path of withdrawal of the slab, hereinafter called simply the transverse direction, while the slab is being drawn from a mold in the continuous casting step of steel and controlling the casting conditions (e.g., secondary cooling pattern, drawing speed, etc.,) so that said profile is optimum with respect to the quality of the slab obtained and applicability of the slab to the CC-DR method.

DESCRIPTION OF THE PREFERRED EMBODIMENT

Now, the invention will be explained with reference to the accompanying drawings.

Figure 1:
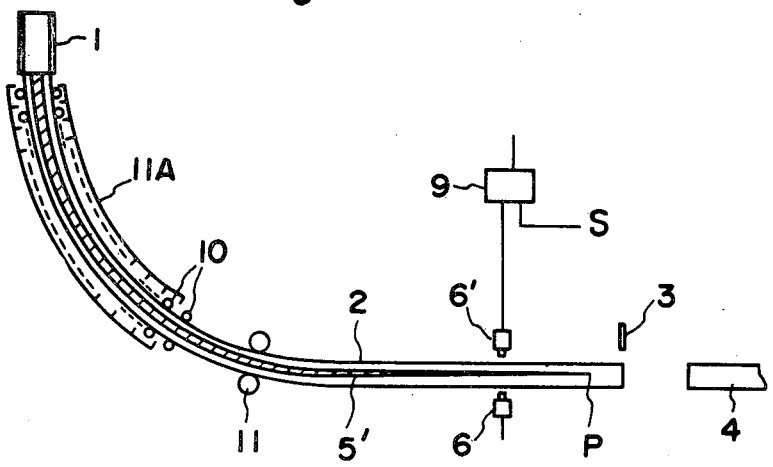
FIG. 1 is a schematic view of a continuous casting method.
Figure 2:
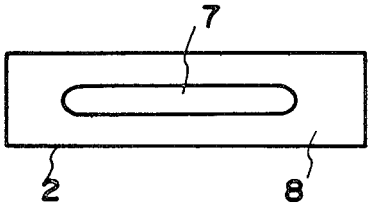
FIG. 2 to FIG. 4 are schematic views showing the profiles of the unsolidified regions in the transverse cross sections of slabs during continuous casting steps under various casting conditions.
Figure 3:
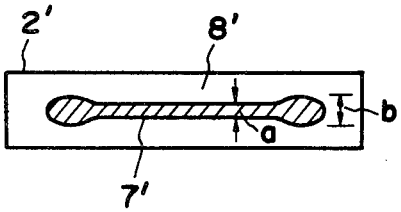
Figure 4:
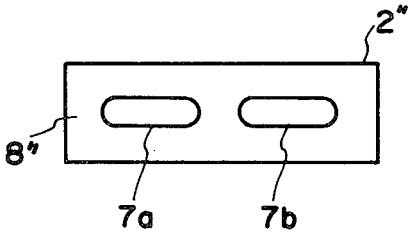

As shown in FIG. 1, in continuous casting of steel, slab 2 withdrawn from a mold 1 by means of pinch rolls 11, passed through a cooling zone and a spontaneous cooling zone, and cut into a unit slab 4 by means of a gas cutter 3. The slab 4 is then supplied to a subsequent rolling step. In this step, the nearer the end P (solidification finished point) of the crater 5 (unsolidified region) in the slab 2 is to the gas cutter 3, the higher the temperature of slab 4 is. Therefore, one of the features of the CC-DR method is that the crater end P is near the cutting point for the slab 2. Accordingly, when the profile of the transverse cross section of the slab formed by the solidified shell of the slab and the unsolidified molten steel in the inside thereof was inspected by means of a slab solidification thickness measuring means 6, 6' at a position near the crater end P on slabs produced by continuous casting under various casting conditions, different profiles as shown in FIG. 2 to FIG. 4 were obtained. FIG. 2 shows a profile of the unsolidified region in the transverse section of a slab 2 obtained under most ordinary cooling and casting speeds. As shown in the figure, the unsolidified region 7 extends in the transverse direction of a slab at almost uniform thickness and the unsolidified region 7 is surrounded by a solidified region 8.

FIG. 3 shows a profile of the unsolidified region 7′ in the solidified region 8′ obtained when the extent of cooling at both the edge portions in the transverse direction of the slab 2′ is reduced as compared with that at the intermediate portion in the transverse direction of the slab and the profile of the unsolidified region 7 is like a dog bone in shape. Furthermore, when the cooling rate at both the edge portions in the transverse direction of a slab is much lower than that at the intermediate portion in the transverse direction of the slab or the intermediate portion only in quickly cooled, the intermediate or central portion is first solidified and then, as shown in FIG. 4, the unsolidified region in the solidified shell 8 of the slab is divided into two unsolidified regions 7*a* and 7*b*.

Figure 5:
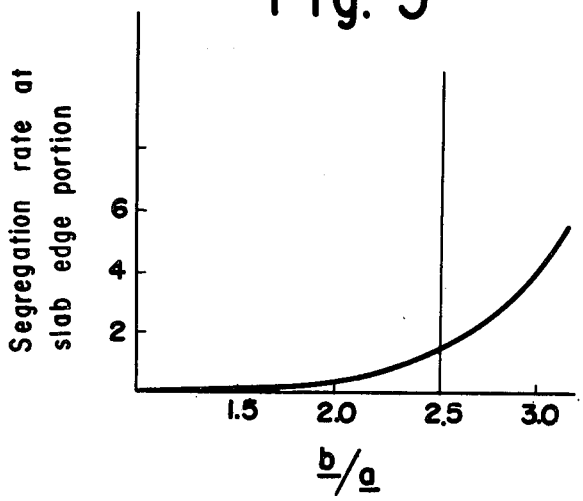
FIG. 5 is a graph showing the relation between the ratio (b/a) of the thickness b of the two end portions of the profile of the unsolidified region in the transverse or width direction of a slab to the thickness a of the intermediate portion of the profile and the segregation rate at the edge portions of the slab.

The relation between the profile of the unsolidified region within the solidified shell of the slab and the segregation ratio at the edge portions of the slab is shown in FIG. 5. That is, the profile of the unsolidified region 7 as shown in FIG. 2 extends in the transverse direction of the slab. As the solidification progresses the size of the unsolidified region is reduced and the segregated impurities are wholly dispersed so there is no problem in the quality of the slab, although the segregation of impurities such as sulfur and the compounds thereof may be concentrated in the central portion. On the other hand, when the profile of the unsolidified region of a slab is as shown in FIG. 4, the impurities in the unsolidified regions 7*a* and 7*b* are segregated in each of the regions when these regions solidify, thereby giving the slab an undesirable quality. Also, as shown in FIG. 3, the unsolidified region may take a so-called dog bone form having the expanded unsolidified region 7′ at each end with a relatively thin intermediate portion. This profile falls between the above-described two profiles and when the slab is used in a conventional way, causes no special problem for the quality of the slab from the viewpoint of segregation.

On the other hand, when the slab is used in the CC-DR method, the temperature of both edge portions of the slab falls to a temperature unsuitable for rolling, so it is necessary to perform edge heating on both edges of the slab.

Figure 6:
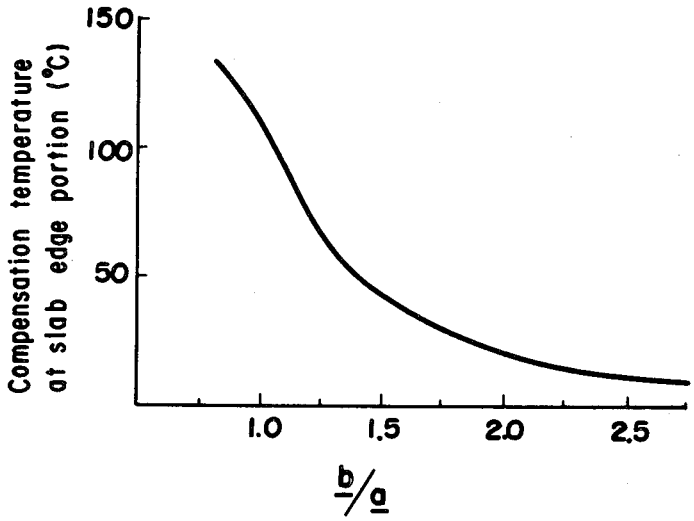
FIG. 6 is a graph showing the relation between the ratio (b/a) of the thickness b of the two end portions of the profile of the unsolidified region in the transverse or width direction of a slab to the thickness a of the intermediate portion of the profile and the compensation temperature at the edge portions of the slab.

Now, the relation between the ratio b/a of the thickness a at the intermediate portion of the profile of the unsolidified region in the transverse cross section of a slab to the thickness b of the expanded portions at both ends of the profile and the compensation temperature during edge heating (the increase in temperature of the edge portions of the slab necessary to make the CC-DR possible) is shown in FIG. 6. That is, in the profile ($b/a \div 1.0$) of the unsolidified region as shown in FIG. 2, the edge portions have cooled quickly and, accordingly, a large amount of heat (increase in temperature) is required for edge heating. On the other hand, in the profiles shown in FIG. 3 and FIG. 4, both edge portions of the slabs are at high temperature and hence only a small amount of heat is required for edge heating. Thus, in this invention the optimum profile of the unsolidified region in the transverse cross section of a slab is determined by two factors—slab quality (the segregation state at the edge portions) and energy-saving (the amount of heat required to heat the edge portions)—and the casting conditions are controlled so as to keep the profile.

Figure 7:
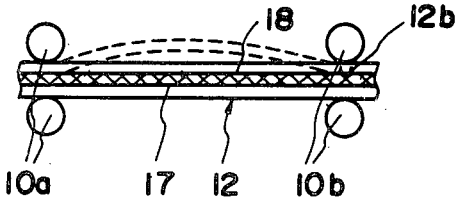
FIG. 7 is a schematic cross sectional view in the lengthwise direction of a slab showing the slab expanded between press rolls during the continuous casting step.
Figure 8:
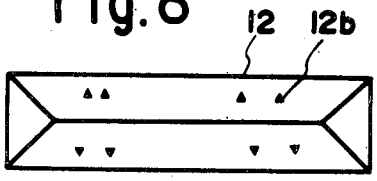
FIG. 8 is a schematic cross sectional view in the transverse direction of a slab showing a high concentration of segregated impurities in the transverse direction of slab caused by the expansion of the slab as shown in FIG. 7.

Furthermore, a slab having an unsolidified region in it is subject to internal cracking. That is, as shown in FIG. 7, when a static pressure is applied to the unsolidified region 17 of a slab 12, depending on the height from the mold to the slab portion, the slab 12 expands between the press rolls 10*a* and 10*b* as shown by the dotted line in FIG. 7. The expansion is removed at rolls 10*b*, and thereby the slab bends to form cracks 12*b* in the inside of the solidified region 18. Molten steel flows into the cracks 12*b* in the unsolidified region 7 and is trapped. Accordingly, as the solidification proceeds in the unsolidified region 7 more segregation occurs and the impurities content increases. Thus, after solidification, when sulfur printing of the transverse cross section of the slab is inspected, cracks 12*b* are detected as dotted high impurity-containing regions as shown in FIG. 8. Thus, the occurrence of internal cracks is undesirable from the point of forming segregation and the internal cracks occur in the thin solidified region and hence in the portion which is liable to expand as shown in FIG. 7.

Figure 9:
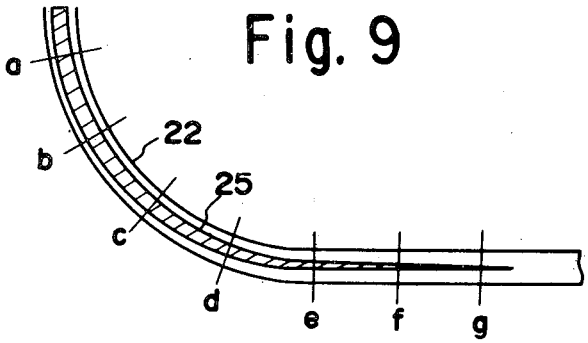
FIG. 9 is a schematic longitudinal sectional view in the longitudinal direction of slab showing the unsolidified region in the inside of the slab during the continuous casting step.

As the result of various experiments, it has been confirmed that the profile of the unsolidified region of the slab described above depends upon the parameters such as the kind of steel, dimensions of the cast slab, pouring temperature, casting speed, cooling condition, etc., but when the inspecting the unsolidified region 25 of a slab 22 at positions specified as a to g in FIG. 9, the profile of the unsolidified region was found to be that of a good slab having no internal crack at any position.

Figure 10:
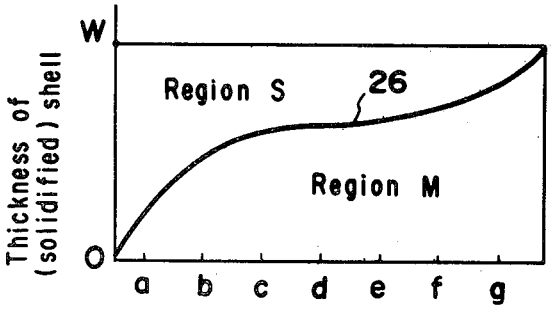
FIG. 10 is a graph showing the thickness of the solidified layer in each position of the unsolidifed region shown in FIG. 9.

FIG. 10 shows a curve 26 obtained by plotting the desired value of the thickness of the solidified shell in each position of the slab, which has been theoretically clarified and experimentally confirmed. The curve is shown by, for example, the following equations:

$$\text{When } di \leqq \frac{A \cdot B}{a(A+B)},\ di = k\sqrt{li/v} \text{ and}$$

$$\text{when } di > \frac{A \cdot B}{a(A+B)},\ di = D - \sqrt{C - \beta li/v}$$

wherein A is the thickness of a slab, B is the width of the slab, di is the thickness of the solidified shell of the slab, k is a solidification coefficient, li is the distance between the pouring position and the inspecting position, v is the casting speed, D is the thickness of a slab, and C and $\beta$ are coefficients.

By the above equations, the desired thickness of the unsolidified region can be immediately obtained from the desired thickness of the solidified shell of the slab. That is, the thickness of the unsolidified region is the thickness of the slab minus the thickness of the solidified shell of the slab. In FIG. 10, region M shows the thickness of the solidified shell of the slab and region S shows the thickness of the unsolidified region in the slab. These thicknesses are those at the intermediate or central portion of a slab in the transverse cross section.

Now, a preferred casting result is not always obtained from judging the effect of cooling only from the thickness of the unsolidified region in a slab. In other words, if cooling for a slab is improperly controlled, in the unsolidified region having a dog bone-like form both the end portions expand excessively and the unsolidified region is divided into two portions 7*a* and 7*b* at a position near the crater end as shown in FIG. 4, and this causes excessive segregation. That is, it is difficult to determine whether the cooling for a slab is correct or not by inspecting only the thickness of the unsolidified region at a specific position in the transverse direction of the slab.

Thus, the inventors have obtained good results by predetermining the position of the crater end P of a slab (in FIG. 1), determining a standard or optimum profile of the unsolidified region which does not cause internal cracking and does not cause excessive segregation about each dimensions of slab, kind of steel, pouring temperature, and casting speed at each inspecting position, and controlling the casting condition so that the actually inspected profile (i.e., the profile in the transverse direction) is same as the pre-determined one or the difference between the profiles is minimized. An example of the standard profiles is illustrated in FIG. 11.

Figure 11:
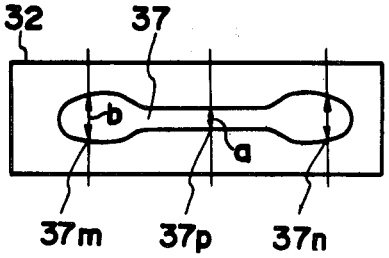
FIG. 11 is a schematic transverse cross sectional view in the transverse or width direction of slab showing the preferred profile of the unsolidified region in the transverse cross section of a slab according to this invention.

In this case, as a measure for describing the profile of the unsolidified region of slab, there is a ratio b/a when the thickness of the unsolidified region 37 of the intermediate portion in the transverse cross section of the slab 32 is defined as a and the thickness of the unsolidified region 37 of both the edge portions of the slab is defined as b as shown in FIG. 11 and for avoiding the formation of a profile having the unsolidified regions 7*a* and 7*b* as shown in FIG. 4, i.e., for maintaining good quality of the slab, it is preferred that the ratio be less than 2.5, particularly less than 1.8 as shown in FIG. 5. Furthermore, for reducing the amount of heat required to heat the edge portions of the slab, i.e., for the purpose of energy-saving, which is one of the objects of this invention, it is necessary that the above-described ratio b/a for the profile of the unsolidified region be less than 1.1 as shown in FIG. 6. Therefore, for keeping the good quality of slab and energy-saving, the ratio b/a is defined as being 1.1–2.5 in this invention. By selecting the ratio as defined above, a slab is obtained that is optimum with respect to both quality and energy-saving.

Furthermore, since, according to this invention, the aforesaid profile must be maintained, at least near the crater end, it is preferred that the inspecting position for determining the profile of the unsolidified region in the transverse cross section of a slab be ahead of the crater end by 1.5–20% of the whole length of the slab in the longitudinal direction between the meniscus of molten steel and the crater end. Also, it is preferred that the thin portion of the transverse sectional profile of the unsolidified region of a slab be disposed about the central portion thereof and the expanded portions at both the ends thereof be spaced away from the edges of the slab by a distance of 0.5–1.5 times the thickness of the slab. When the expanded portions of the unsolidified region in the slab are in these positions, the thin portion of the unsolidified region is 2 mm or more thick. This position may also be expressed in terms of time, as follows. That is, the position is within 0.5–5 minutes before the completion of solidification. Thus, if the inspecting for the profile is made 5 minutes before the completion of the solidification of slab, the influence of the form of the profile of the unsolidified region on segregation is still too small and if the inspection is made less than 0.5 minutes before the completion of the solidification, it is difficult to inspect the unsolidified portion because of limitations on the accuracy of a thickness measuring device for solidified shell. A satisfactory inspection of the profile may be made by comparing the thickness of b at the expanded portions 37*m* and 37*n* with the thickness of the central portion 37*p* in the unsolidified region 37 of a slab as shown in FIG. 11, but as the case may be, a good result is obtained by providing a large number of inspecting positions in the transverse direction of the slab and comparing the thickness measured at each inspecting position.

It is preferred to inspect the thickness of the unsolidified region by using one inspecting device scanning in the transverse direction of a slab, but plural inspecting devices may be placed at positions corresponding respectively to definite positions in the transverse direction of a slab and the profile may be inspected from such plural positions.

In this invention it is preferred to use a non-contact type electromagnetic ultrasonic thickness measuring instrument for inspecting the thickness of the solidified shell or the unsolidified region in place of a conventional contact type thickness measuring instrument. The reason is as follows. In the case of, for example, a conventional thickness measuring instrument utilizing ultrasonic waves, it is required to use an ultrasonic conductor such as a roll, water or oil in contact with shell and hence in the case of inspecting a high-temperature slab, mechanical wear or scratches are liable to occur on the surface of a slab in the case of using a roll, and the slab is partially supercooled or is given surface scratches in the case of using a cooling medium such as water. By using a non-contact type electromagnetic ultrasonic thickness measuring instrument, the above-described difficulties can be wholly overcome. The preferred non-contact type electromagnetic ultrasonic thickness measuring instrument used in this invention is disclosed in Japanese Patent Publication (OPI) Nos. 98,290/'79; 95,288/'79 and 98,289/'79 filed by the same applicant.

Also, for employing the CC-DR method, it is necessary to supply a slab having proper dimensions and at a temperature high enough to be suitable for rolling and hence it is necessary to control the casting condition so that the crater end of a slab formed in the final step of the continuous casting step is disposed near the inlet side of a cutting device of slab. Therefore, in this invention a thickness measuring instrument is placed in front of the cutting device (usually a gas cutter) to measure the thickness of the solidified shell of a slab and the thickness of the unsolidified region and when the value thus inspected differs from the pre-determined standard value, the casting conditions are controlled so that the difference between them becomes less, and thereby the position of the crater end in the slab (i.e., the solidification completion position) is made to coincide with the pre-determined position.

Figure 12:
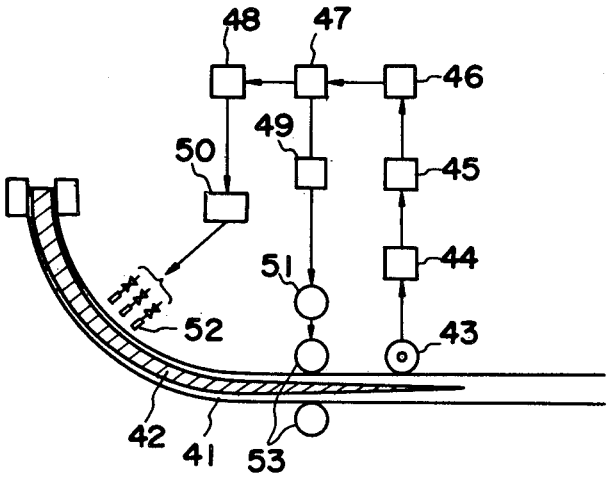
FIG. 12 is a schematic block view showing a control means for controlling the profile of the unsolidified region in the transverse direction of a slab according to this invention.

FIG. 12 is a schematic block diagram showing a control means of this invention. An inspection signal from an ultrasonic thickness measuring instrument (solidified shell thickness gage) 43 is sent to a signal processing device 44, and thereby the profile of the crater, i.e., the unsolidified region 42 in the transverse direction of a slab 41 is determined. Then the profile signal is sent to a comparing arithmetic unit 45, wherein the profile is compared with a pre-determined standard profile and the difference is introduced into a device 46 for determining the need for control. When the aforesaid difference is in an allowable range, no signal is sent from the device 46 but when the difference is over the allowable range, the correction signal is sent to a device 47 for deciding the control system to be used. In the device, it is determined whether cooling control only is necessary or whether cooling control and casting speed control are necessary and according to the determination, a cooling control operator 48 and a casting speed control operator 49 are operated, and thereby a valve means 50 or a pinch roller motor 51 is operated. Thus, the amount of cooling water (water or mist) from nozzles 52 is controlled or the speed of the pinch roller 53 is changed.

FIG. 12 shows one specific embodiment of this invention but other systems may be employed in this invention. For example, the system from the signal processing device to the cooling and casting speed control operators may be constructed as one computer control device to perform the steps from the signal sensing operation to the control operation in sequence.

Figure 13:
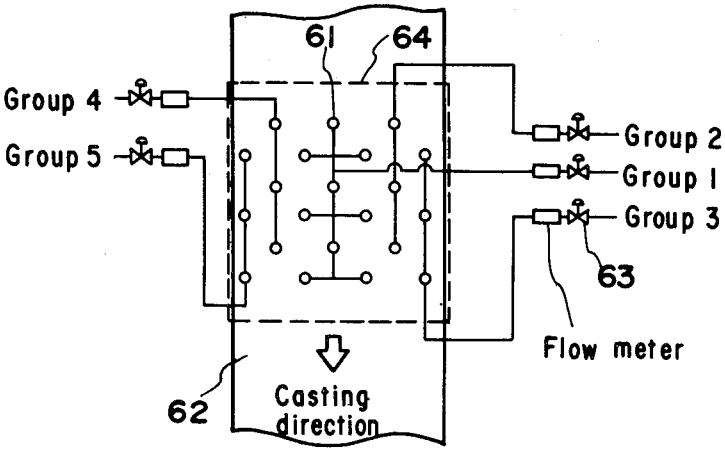
FIG. 13 is a block diagram showing a cooling control means for slab.

FIG. 13 is a partial block diagram showing in detail the cooling control. In this embodiment, twenty-one cooling nozzles 61 are disposed in a unit cooling zone 64 of a slab 62 and the nozzles are arranged in five groups. When, for example, the temperature of the edge portions of the slab 62 falls too much, flow amount control valves 63 of the nozzle groups 3 and 5 are controlled to reduce the amount of flow of water and when the temperature of the central portion of the slab 62 increases too much, the flow amount control valve 63 of the nozzle group 1 is controlled to speed up the cooling.

The invention will be further explained by referring to the following examples.

Example 1 (cooling pattern control)

While a slab 250 mm thick and 1,300 mm wide was being produced by continuous casting at a casting speed of 1.6 meters/min, the profile of the unsolidified region in the transverse direction of the slab was inspected from a position of 3.8 meters ahead of the expected crater end point (the position spaced from the end point 10.8% of the distance between the meniscus of molten steel in the mold and the expected crater end point in the lengthwise direction of the slab) by scanning in the transverse direction of the slab using a non-contact type ultrasonic thickness measuring instrument. The difference between the profile thus inspected and the standard profile was as shown in Table 1, so the cooling pattern of the slab was changed as shown in Table 4, and, as a result, the profile of the unsolidified region of the slab became almost the same as the standard profile after about 13 minutes. Inspection of the final product showed no internal cracks, etc., and the segregation was not over an allowable range. Also, on supplying the slab thus obtained directly to the rolling step, the amount of heat necessary to raise the temperature at the edge portions of the slab was greatly reduced as compared to the case of not performing the profile control according to this invention. In Table 1, 37*m*, 37*n* and 37*p* were employed for showing the end portions and the central portion, respectively of the unsolidified region 37 of the slab 32 as shown in FIG. 11. In addition, each of the positions 37*m* and 37*n* was at a position of 200 mm (0.8 times the thickness of the slab) inwardly of the edge of the slab.

TABLE 1

| | Position in the transverse direction of unsolidified region | | | | Increase in temp. |
|---|---|---|---|---|---|
| | 37m | 37n | 37p | b/a | °C.* |
| Standard profile | 29 mm | 29 mm | 24 mm | 1.21 | — |
| Inspected profile | 39 mm | 37 mm | 38 mm | 0.97–1.03 | 120 |
| Profile after correction | 28 mm | 29 mm | 24 mm | 1.17–1.21 | 75 |

*at the edge portions of the slab.

Example 2 (cooling pattern control)

A slab having the same dimensions as in Example 1 was produced by continuous casting under the same casting conditions as in Example 1. During casting the profile of the unsolidified region in the transverse direction of the slab was inspected as a point 2 meters ahead of the expected crater end point, i.e. 5.7% of the lengthwise direction along the slab. The difference between the inspected pattern and the standard pattern was as shown in Table 2, so the cooling pattern was changed as shown in Table 4, and, as a result, the profile became almost the same as the standard profile after about 16 minutes. It was confirmed that there were no problems in connection with the quality of the product and the amount of heat necessary to raise the temperature at the edge portions of the slab to a state suitable for CC-DR method was remarkably reduced.

TABLE 2

| | Position in the transverse direction of unsolidified region | | | | Increase in temp. |
|---|---|---|---|---|---|
| | 37m | 37n | 37p | b/a | °C.* |
| Standard profile | 48 mm | 48 mm | 24 mm | 2.0 | — |
| Inspected profile | 32 mm | 31 mm | 31 mm | 1.0–1.03 | 120 |
| Profile after correction | 49 mm | 48 mm | 24 mm | 2.00–2.04 | 20 |

Example 3 (casting speed and cooling pattern controls)

A slab having the same dimensions as in Example 1 was produced by continuous casting under the same casting conditions as in Example 1. During casting the profile of the unsolidified region in the transverse direction of the slab was inspected at the same position as in Example 1, and the difference between the inspected profile and the standard profile was as shown in Table 3. The casting speed was changed to 1.5 meters/min. and the amount of cooling water was changed as shown in Table 4, and as a result, the profile of the unsolidified region was restored to almost the same profile as the standard profile. It was confirmed that there were no problems as to quality, etc., of the product and the amount of heat necessary to raise the temperature at the edge portions of the slab was remarkably reduced.

TABLE 3

| | Position in the transverse direction of unsolidified region | | | | Increase in temp. |
|---|---|---|---|---|---|
| | 37m | 37n | 37p | b/a | °C.* |
| Standard profile | 35 mm | 35 mm | 24 mm | 1.5 | — |
| Inspected | 35 mm | 31 mm | 33 mm | 0.94– | 120 |

TABLE 3-continued

| | Position in the transverse direction of unsolidified region | | | | Increase in temp. |
|---|---|---|---|---|---|
| | 37m | 37n | 37p | b/a | °C.* |
| profile | | | | 1.06 | |
| Profile after correction | 35 mm | 34 mm | 24 mm | 1.42–1.5 | 40 |

TABLE 4

| | Cooling group | Amount of cooling water after correction to that before correction |
|---|---|---|
| Example 1 | 1 | 125% |
| | 2, 4 | 115% |
| | 3, 5 | 110% |
| Example 2 | 1 | 107% |
| | 2, 4 | 75% |
| | 3, 5 | 70% |
| Example 3 | 1 | 105% |
| | 2 | 85% |
| | 3 | 70% |
| | 4 | 90% |
| | 5 | 80% |

What is claimed is:

1. A method for continuous casting of steel which comprises:

continuously casting a steel slab;

withdrawing the slab along a withdrawal path defining a withdrawal direction;

inspecting a profile of the unsolidified region in the solidified shell of a slab in a direction transverse to the withdrawal direction of the slab before completion of solidification of the slab obtained by said continuous casting step; and controlling the cooling pattern of the slab so that the thickness ratio of said profile is in the following range;

$$b/a = 1.1\text{–}2.5$$

wherein a is the thickness of the central portion of the unsolidified region in the transverse direction of the slab (mm) and b is the thickness of the edge portions thereof (mm).

2. The method as claimed in claim 1 wherein the controlling step further comprises controlling the casting speed of the slab.

3. The method as claimed in claim 1 wherein the inspection comprises causing a non-contact type electromagnetic ultrasonic thickness measuring instrument to scan the slab in the transverse direction of the slab, and using the output of said instrument in determining the thickness ratio.

4. The method as claimed in claim 1 wherein the inspection comprises positioning a plurality of non-contact type electromagnetic ultrasonic thickness measuring instruments at intervals in the transverse direction of the slab, and using the outputs of said instruments in determining the thickness ratio.

* * * * *